United States Patent [19]

Kennedy

[11] 4,178,529

[45] Dec. 11, 1979

[54] FLIP-HEADER AND TUBE BASE FOR CTD MOUNTING WITHIN AN IMAGE INTENSIFIER

[75] Inventor: Andrew J. Kennedy, Lorton, Va.

[73] Assignee: The United States of America as represented by the Secretary of the Army, Washington, D.C.

[21] Appl. No.: 922,017

[22] Filed: Jul. 5, 1978

[51] Int. Cl.[2] ..... H01J 39/02; H01J 5/50

[52] U.S. Cl. ..... 313/102; 313/318

[58] Field of Search ..... 313/94, 101, 102; 250/273 VT

[56] References Cited

U.S. PATENT DOCUMENTS 3,814,964 4/1979 Ace ..... 313/94 X

FOREIGN PATENT DOCUMENTS 7613718 6/1977 Netherlands ..... 313/94

1401434 7/1975 United Kingdom ..... 313/101

*Primary Examiner*—Robert Segal

*Attorney, Agent, or Firm*—Nathan Edelberg; Milton W. Lee; Max L. Harwell

[57] ABSTRACT

A flip-header for mounting a charge transfer device, such as CCD, CTD, semiconductor diode arrays and the like, thereon to a ceramic tube base of an image intensifier tube and variations of the basic tube configurations to accommodate proximity focus of the photocathode and the charge transfer device. The flip-header with the charge transfer devices mounted thereon are separately prebaked at a lower temperature than the other portions of the tube assembly, namely the tube base, tube body, and the faceplate. The flip-header is then set inside the tube.

12 Claims, 3 Drawing Figures

FLIP-HEADER AND TUBE BASE FOR CTD MOUNTING WITHIN AN IMAGE INTENSIFIER

The invention described herein may be manufactured, used, and licensed by the U. S. Government for governmental purposes without the payment of any royalties thereon.

BACKGROUND OF THE INVENTION

The present invention is in the field of flip-headers for holding charge transfer devices (CTDs) in a high voltage device, such as an image intensifier tube.

Flip chips have been proposed but they are not considered a viable approach to intensified charge coupled devices (ICCDs) or intensified charge injection devices (ICIDs) because the edges of the semiconductor flip chips are too rough and produce field emission, and are exposed to greater than the operational voltage that cause in excess of $10^5$ volts per centimeter electric fields. An electric field of this magnitude virtually assures high voltage electric breakdown. In the present inventive flip-header this problem is solved by not having either the rough edges on the flip-chip CTD input side or the rough perimeter where the necessary thinning of the CTD occurs from the thicker outer portion. The thinned center portion of the charge transfer device is necessary for high quantum efficiency of the electron bombarded silicon, or semiconductor, mode operation (EBS) when operated in the EBS mode. Also, in prior art ICIDs there were two Kovar flanges adjacent to the already bonded CCD that had to be arc welded prior to cathode processing.

CROSS-REFERENCE TO RELATED APPLICATION

The method by which a long leakage path ultrasmooth surface tube wall for a typical image intensifier, in which the present invention may be practiced, is the subject of a concurrently filed patent application by the present inventor, and is entitled "High Strength Extended Leakage Path Ceramic Tube Wall for Image Intensifier and Method of Manufacture."

SUMMARY OF THE INVENTION

The present invention relates to improved image intensifier tubes and specifically to embodiments of flip-headers with charge transfer device attached thereto, and the modifications of the basic image intensifier tube configuration to accommodate the flip-header onto the tube base and the charge transfer device in proximity focus with the photocathode.

Advantages of the present inventive flip-header and image intensifier tube modifications to accommodate the flip-header are the following. The step of mounting the flip-header and the CTD to the image intensifier tube is now after the higher temperature bake of the tube body, the faceplate, and cathode whereas in the prior art ICTDs the metal flanges that were adjacent to the already bonded CTDs thereon had to be arc welded to the tube body prior to the cathode processing. Sometimes the arc welding process destroyed the very delicate and temperature sensitive CTDs. The tube body can also be outgassed more efficiently by higher voltage electron beam scrubbing, of say up to 20 kilovolts, with several microamps per square centimeter current density when the CTDs are not prepositioned. The usefulness of the present flip-header concept is also applicable in the magnetically focused tube scheme, or in the inverter tube structure if the focusing and correcting electrodes can be put in place after the insertion of the flip-header into its proper sockets, or alignment keys.

In the present inventive concept, the tube modification is that of the input transparent faceplate wherein the flip-header, with the CTD having a plurality of CTD electrical leads therefrom, does not have the flange of the prior art type thereon to mate with the image intensifier tube but is slotted to alignment keys in the ceramic tube base.

The thin side of the CTD is in proximity focus with the cathode on the faceplate. The flip-header also has an array of electrical conductors therein connected to a plurality of pins extending therefrom on the flip side. The CTD electrical leads are connected to respective electrical conductors. The electrical conductors fit into a plurality of hot or cold indium filled wells in the ceramic tube base. The plurality of indium wells are electrically connected to an array of electrical leads within the ceramic tube base. The array of electrical leads are connected to a plurality of electrical pins that are connected to external electronic means. The flip-header has a conductive refractory metal plate on one side thereof with an extended lip over the thick outer rim of the CTD. The conductive refractory metal is at ground potential by a tube body connection of a Kovar ring between the tube wall and the tube base.

The present invention will become better understood with reference to the drawings and the specification.

IN THE DRAWINGS

DETAILED DESCRIPTION OF EMBODIMENTS

The prior art headers required a tube flange, as shown, that was welded to the tube body to properly mate with the image intensifier tube wall. There is also a second heliarc welded flange, known as the seal flange, to which a plate is welded after mounting the CTD to produce an ultra-high vacuum seal. The present flip-header does not use the flange but retains the connector pins in a similar configuration. The edges of the molybdenum alloy CTD mounting stage and the pump-out holes were so rough that high voltage breakdown often occurred. The present invention does not need the seal flange thereon, and thus does not have the risk of damaging the CTD material by the prior art welding step. A conductive refractory metal plate on the input side of the flip-header has a smooth well rounded extended lip that extends out from the thick portion and over the thin portion of the CTD. This same conductive refractory metal plate mates with a spring loaded electrical contact that is attached to an electrically grounded Kovar ring or an electrical pin on the tube body.

Figure 1:
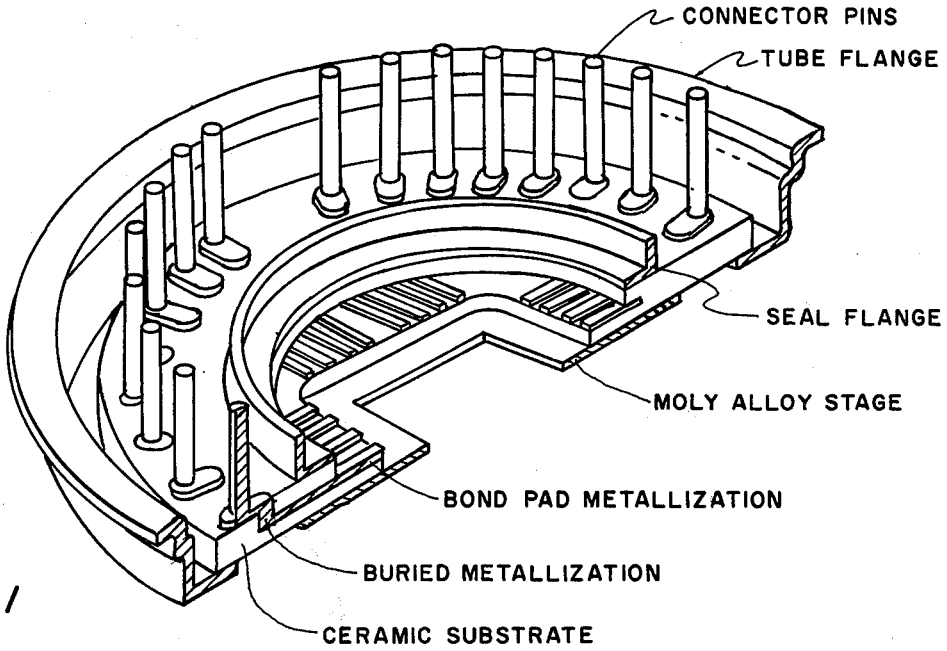
FIG. 1 illustrates a prior art double heliarc welded header for an intensifier CTD tube.
Figure 2:
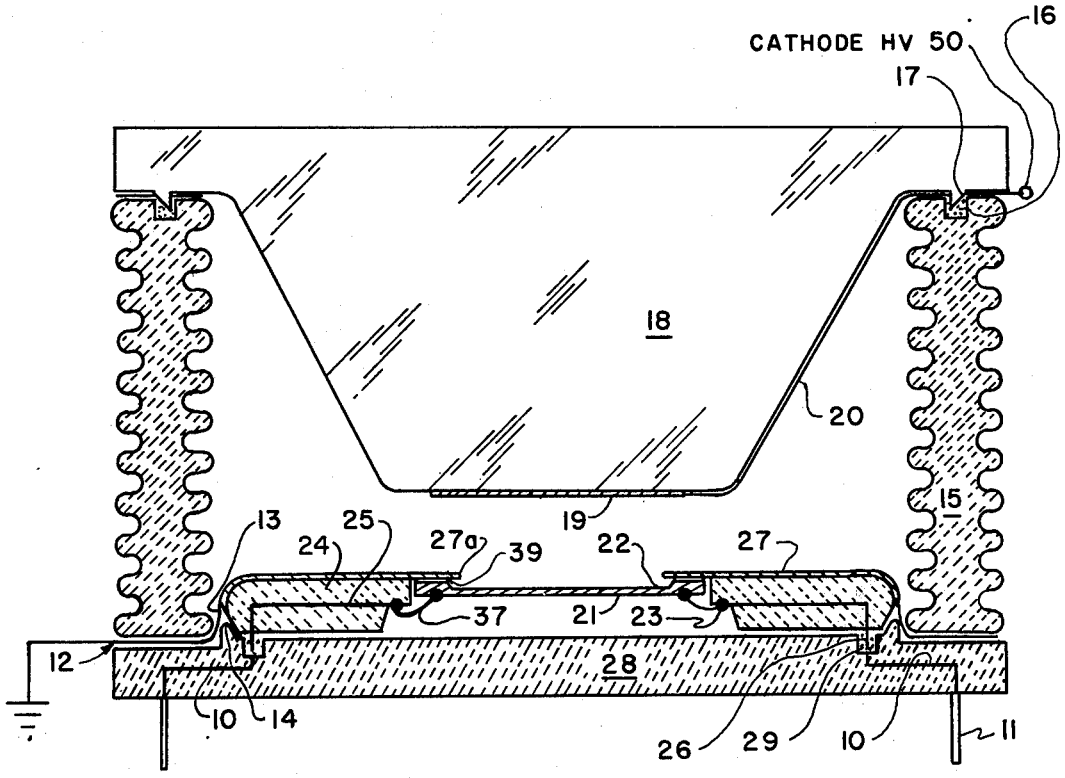
FIG. 2 shows one embodiment of the present flip-header and tube base invention.
Figure 3:
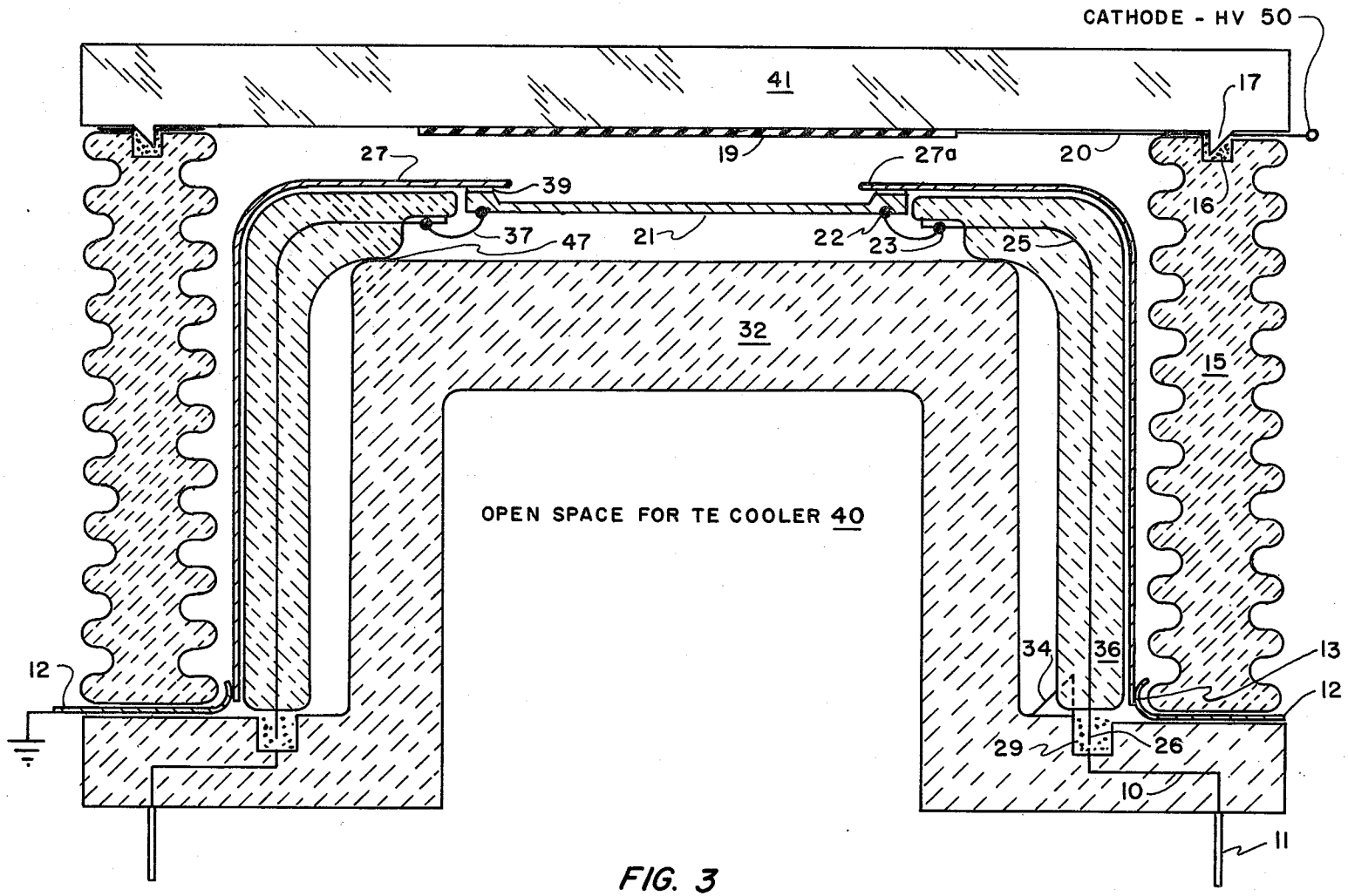
FIG. 3 shows a second embodiment of the present invention.

Look now at FIGS. 2 and 3 for explanation of the present flip-headers as mated with the image intensifier tube. Numeral 15 represents the ceramic tube wall. FIG. 2 shows an embodiment wherein the tube base and flip-header are generally flat and the transparent faceplate 18 is protruded inward reentrant toward the flip-header wherein the photocathode 19 is in proximity focus with the CTD 21. The cathode high voltage source (not shown) is connected by terminal 50 to the photocathode. The high voltage is connected to photocathode 19 by an electrical lead from terminal 50 to an indium alloy filled concentric groove 16 and thence by a conductive metallization layer 20 on faceplate 18 that is electrically contacted to the photocathode. The photocathode is preferably made of Group III–V materials, but may be any vacuum deposited IR, visible, or ultraviolet photocathode. Faceplates 18 of FIg. 2 and 41 of FIG. 3 may be made of glass, quartz, magnesium fluoride, or fiber optic glass. Number 17 shows a knife sealing edge that is made out of the transparent faceplate material, or alternatively may be made of copper or copper plated Kovar which, in the case of a glass faceplate, is radio frequency fused to the faceplate in the well known manner. A Kovar ring 12, that is about 10 mils thick, is electrically grounded to the tube wall 15 and tube base 28 and has a spring loaded electrical contact 13 connected thereto on the inside portion of the tube wall 15.

The flip-header of FIG. 2 is comprised of the ceramic body 24 having an array of built-in electrical conductors 25 connected to a plurality of external electrical pins 26. The number of electrical conductors and external pins may be on the order of 35 to 45. The above mentioned conductive refractory metal plate 27, such as a molybdenum alloy, is bonded to ceramic body 24 and is electrically connected to the spring loaded electrical contact 13, which may or may not be circular. Plate 27 may also be grounded through one of the electrical conductors 25. The other end of 27 is bonded to the thick portion of the CTD 21 preferably by a silicon gold eutectic alloy seal 39, or by beam leads. Metal plate 27 has a smooth well rounded extended lip **27*a* that extends past the thick portion and over the thin portion of 21. The thick portion of CTD 21 is about 100–200 micrometers and the thin portion is about 10 micrometers. A plurality of connecting wires 37, such as 1 mil diameter gold wires, are bonded by bonding pads 22 and 23 respectively to the output side of the CTD and to one each of said array of electrical conductors 25**.

The ceramic tube base 28 is comprised of a plurality of electrically conductive material wells 29, such as indium wells or spring bonded sockets that are made of metals that preserve their springy properties even after high temperature processing, such as molybdenum, tungsten, or copper-beryllium alloys. Wells 29 are electrically connected to a plurality of electrical pins 11 by an array of built-in electrical leads 10 built in the ceramic base 28. Ceramic base 28 also has one or more alignment keys 14 for aligning the flip-header with base 28. Electrical pins 11 may be plugged into some electronic means for CTD drive electronics and image signal processing. Even though pins 11 are shown coming out the bottom of 28, they could alternatively extend out from the side in some circumstances. Electrical pins 26, on the output of the flip-header, are pressed into the indium filled wells 29, or spring bonded sockets, and are set to hold electrical contact with leads 10.

One of the salient features of this invention is the extended lip **27*a* that allows much higher operating voltages before voltage breakdown because of the shielding of rough edges of CTD 21 by the refractory metal plate 27 at 27*a*. The conductive path through 27*a*, 27, 13, and 12 to the electrical ground bleeds off stray electrical current from the photocathode 19 and backscattered electrons from the CTD 21**, thus allowing optimum high voltage operation of the image intensifier.

The second embodiment as shown in FIG. 3 has essentially the same flip-header as that shown in FIG. 2 except that the ceramic body, represented as 36, of this flip-header now has a raised portion with longer legs and obviously longer electrical conductors 25 therein and the ceramic tube base, represented as 32, has a centrally raised portion that rests against the ceramic body 36 at common areas 47. The raised portion of 32 leaves an open space 40, which may contain a thermoelectric cooler inserted therein. Numeral 34 signifies one or more alignment keys for aligning flip-header ceramic body 36 with the tube base 32.

The method of processing the image intensifier tube with the flip-header and tube base are as follows. Items of the tube are processed separately. The tube wall 15 with the tube base 28 brazed thereto by Kovar ring 12 are baked at 400° C. to 450° C. for half a day. The tube wall and base may also be outgassed during this time by high voltage and high current density, of about 1–10 micro-amps per square centimeter, electron beam scrubbing. The CTD device and flip-header are baked out at close to but under 350° C. The photocathode is baked out at about 670° C. The photocathode may be gallium arsenide.

After the tube wall and tube base are baked out and the CTD and flip-header are baked, the flip-header with the CTD bonded thereto are mounted in the tube base. The next step is the Group III–V photocathode activation with cesium and oxygen and transferring it onto the tube body for sealing. The tube body may be preconditioned with cesium. The last step is the in-process vacuum seal of the knife edge 17 into the indium well 16.

Although only two embodiments of the invention have been illustrated and described, various changes may be made by one skilled in the art without departing from the scope of the invention.

I claim:

1. In a modified image intensifier tube, a tube base support body and flip-header device with a semiconductor charge transfer device thereon in proximity focus with the photocathode, other overall device comprised of:

a ceramic tube base having a plurality of electrically conductive material wells that are electrically connected by built-in electrical leads to a plurality of output pins, said tube base brazed to a tube wall with an electrically grounded Kovar ring therebetween;

a flip-header comprised of a ceramic body having an array of built-in electrical conductors connected to a plurality of external electrical pins for insertion into said plurality of electrically conductive material wells and a conductive refractory metal plate over the outside of the ceramic body that is connected by a spring loaded electrical contact to said electrically grounded Kovar ring at one end and has a smooth well rounded extended lip out from the ceramic body on the other end that extends past an electrically grounded thick portion of a charge transfer device and over a portion of the thinned region wherein a plurality of electrical connecting wires are attached between the outputs of said charge transfer device and a plurality of bonding pads connected to said array of built-in electrical conductors; and an input transparent faceplate having a photocathode positioned opposite said charge transfer device on said flip-header and a knife sealing edge that is inserted in an indium alloy filled concentric groove built in said tube wall for sealing the ultra high vacuum in said image intensifier tube wherein a cathode high voltage is connected through said indium filled alloy to said photocathode and wherein said extended lip of said conductive refractory metal plate bleeds stray charges from said photocathode and backscatter charges from said charge transfer device to allow higher operating voltage in said image intensifier tube.

2. The device as set forth in claim 1 wherein said ceramic tube base and said flip-header are generally flat and said input transparent faceplate is protruded inward reentrant toward said flip-headers wherein said photocathode is in proximity focus with said charge transfer device.

3. The device as set forth in claim 1 wherein said ceramic tube base and said flip-header have a centrally raised portion and said input transfer faceplate is generally flat wherein said photocathode and said charge transfer device are in proximity focus.

4. A device as set forth in claim 1 wherein said input transparent faceplate is made of quartz.

5. A device as set forth in claim 1 wherein said input transparent faceplate is made of magnesium fluoride.

6. A device as set forth in claim 1 wherein said input transparent faceplate is glass.

7. A device as set forth in claim 1 wherein said input transparent faceplate is fiber optical glass.

8. A device as set forth in claim 6 wherein said knife sealing edge is a copper plated Kovar.

9. A device as set forth in claim 6 wherein said knife sealing edge is copper.

10. A device as set forth in claim 7 wherein said conductive refractory metal plate is a molybdenum alloy.

11. A device as set forth in claim 10 wherein said electrically conductive material wells of said ceramic tube base in which said electrical pins of said flip-header is inserted are filled with indium.

12. A device as set forth in claim 10 wherein said electrically conductive material wells of said ceramic tube base in which said electrical pins of said flip-header is inserted are equipped with copper-beryllium alloy sockets.

* * * * *